US012349843B2

(12) United States Patent
Van Zuijlen

(10) Patent No.: US 12,349,843 B2
(45) Date of Patent: Jul. 8, 2025

(54) CONVERTIBLE HANDWASH STATION

(71) Applicant: DaNiFé B.V., Zoetermeer (NL)

(72) Inventor: Johannes Adrianus Anthonius Van Zuijlen, Reeuwijk (NL)

(73) Assignee: DaNiFé B.V., Zoetermeer (NL)

( * ) Notice: Subject to any disclaimer, the term of this patent is extended or adjusted under 35 U.S.C. 154(b) by 210 days.

(21) Appl. No.: 18/208,935

(22) Filed: Jun. 13, 2023

(65) Prior Publication Data

US 2023/0397771 A1 Dec. 14, 2023

(30) Foreign Application Priority Data

Jun. 13, 2022 (NL) ..... 2032141

(51) Int. Cl.
*A47K 1/05* (2006.01)
*A47K 1/02* (2006.01)
*E03C 1/18* (2006.01)

(52) U.S. Cl.
CPC ..... *A47K 1/05* (2013.01); *A47K 1/02* (2013.01); *E03C 1/18* (2013.01)

(58) Field of Classification Search
CPC ... A47K 1/02; A47K 1/04; A47K 1/05; A47K 1/10; A47K 1/12; A47K 11/02; A47K 11/00; A47K 4/00; A47K 2210/00; E03C 1/14; E03C 1/16; E03C 1/18; A61G 7/0005; A45D 19/04; B64D 11/02
See application file for complete search history.

(56) References Cited

U.S. PATENT DOCUMENTS 1,405,205 A * 1/1922 Griggs ..... A47K 1/05 4/644
4,718,131 A * 1/1988 Kitamura ..... A47K 4/00 4/312
4,769,863 A 9/1988 Tegg et al.
7,730,561 B2 * 6/2010 Kostelyk ..... E03B 11/02 4/625
8,239,982 B2 * 8/2012 Fryan ..... E03D 1/003 4/644

FOREIGN PATENT DOCUMENTS

DE 39 11 149 C1 10/1990
KR 10-0712147 B1 4/2007

OTHER PUBLICATIONS

Netherlands Search Report and Written Opinion, Application No. 2032141, Jun. 13, 2022, 9 pages.

* cited by examiner

*Primary Examiner* — Erin Deery
(74) *Attorney, Agent, or Firm* — Hoffmann & Baron, LLP

(57) ABSTRACT

A handwash station being frontally accessible from a user position, in which the hand-wash station has a base body including a front side, left side and right side, which base body supports a pivotally connected sink unit including a sink and a faucet for dispensing water. The handwash station is convertible from a left to a right version. In the left version, the sink unit is pivotable to the left side about a left pivot, and in the right version, the sink unit is pivotable to the right side about a right pivot. Due to the convertibility, the same handwash station is suitable to be placed either against a left or a right side wall of a portable restroom.

12 Claims, 8 Drawing Sheets

CONVERTIBLE HANDWASH STATION

CROSS-REFERENCE TO RELATED APPLICATIONS

This application claims the benefit of Netherlands Application No. 2032141, filed Jun. 13, 2022, the contents of which is incorporated by reference herein.

FIELD OF THE INVENTION

The invention relates to a handwash station and a portable restroom having a sanitary space including a handwash station. The handwash station is frontally accessible from a user position. The handwash station has a base body for supporting a pivotally connected sink unit. The base body has a front side, a left side and a right side. The sink unit has a sink and a faucet for dispensing water to the sink.

BACKGROUND OF THE INVENTION

US7730561BB discloses a portable hand-wash sink station which is sized to fit within a typical portable restroom. The hand-wash sink station comprises a vertically elongated used water storage tank and a fresh water tank is disposed within a central portion of the used water storage tank. The sink station further includes an upper column that serves as a sink top. The upper column includes two sink bowls which are formed in a lower portion on opposite sides of the sink station. Further, the upper column includes two faucets disposed above each sink bowl. Water is supplied from the freshwater tank to the faucets through a system which includes two foot-operated pumps to pump water through conduits when the user of the unit applies foot pressure upon the pumps.

The upper column is attached to the used water storage tank and may be tilted with respect to the used water storage tank by a hinge. The upper column may be secured to the used water storage tank through the use of a latch that may be further secured through the use of a lock to resist tampering. Maintenance personnel may pivot the upper column away from the used water storage tank for inspection or replenishment of the freshwater tank.

U.S. Pat. No. 4,769,863 discloses another hand was unit with a tank and a dispenser housing. The dispenser housing is pivotally connected by a hinge to an open-top container.

The above mentioned portable hand-wash sink stations are stand-alone units. However, in many occasions, a handwash station is to be installed inside a small mobile sanitary unit having sidewalls delimiting only a floor area of about 1.0 $m^2$. Such a small sanitary unit includes a toilet seat and often also a urinal. A problem to many known hand wash sink stations is that such an object do not properly fit in such a small sized mobile sanitary unit. A configuration of a hand-wash sink station is desired which provides an improved fit in a mobile sanitary unit.

Regarding the above-mentioned prior art, it is remarked that any discussion of documents, acts, materials, devices, articles or the like included in the present specification is for the purpose of providing a context for the present invention, and is not to be taken as an admission that any such matters form part of the prior art or were before the priority date of each claim of this application common general knowledge in the field relevant to the present invention.

SUMMARY OF THE INVENTION

The general object of the present invention is to at least partially eliminate the above mentioned drawback and/or to provide a usable alternative. More specific, it is an object of the invention to provide a hand wash station having a configuration which provides an improved fit of the hand wash station inside a mobile sanitary unit.

According to the invention, this object is achieved by a handwash station as described herein.

In use, a user stands in front of the handwash station. The handwash station has a front side, left side and a right side and is accessible from a user position in front of the handwash station. Preferably, the handwash station has a planar back side for placement of the handwash station against a wall.

The handwash station is formed by a base body and a sink unit. The sink unit is positioned on top of the base body. The sink unit is pivotally connected to the base body to allow access to an inner space of the base body. The inner space of the base body may include a water storage. By pivoting the sink unit away from the base body, an operator may get access to the inner space to carry out maintenance. The operator may empty or replenish the water storage while keeping the sink unit in an open position.

According to the invention, an improvement is obtained by providing a handwash station which is convertible from a left to a right version. Depending on a provided version, the sink unit is pivotable either to the left or to the right. In the left version of the handwash station, the sink unit is pivotable to the left side about a left pivot. In the right version of the handwash station, the sink unit is pivotable to the right side about a right pivot. The left pivot has a left pivot axis being situated at a left region of the handwash station, and the right pivot has a right pivot axis being situated at a right region of the handwash station. Each pivot includes a pivot member and a complimentary pivot member which form a pair of pivot members. The left and right pivot member are provided at a bottom region of the sink unit, and the left and right complementary pivot member are provided at a top region of the base body. Each of the left and right pivot can be formed by selectively connecting the pair of pivot members by a pivot shaft which defines the pivot axis. A selective connection of the pivot members of one of the left or right pivot by the pivot shaft determines whether a left or right version of the handwash station is obtained.

The available selection of a left or right version of the handwash station provides an advantage in placing the handwash station inside a portable restroom. Portable restrooms have a minimal floor area. Normally, the handwash station is positioned at a front region right behind a door of the portable restroom which necessitates a backwards directed pivoting movement of the sink unit to allow maintenance. Due to the possibility of a left or right version, the same handwash station is suitable to be placed to a left or right side wall of the portable restroom at the front region. Advantageously, the possibility to install the handwash station in a left or right version always allows the backwards directed pivoting movement of the sink unit in both situations.

In an embodiment of the handwash station according to the invention, each pivot comprises a pivot shaft which is releasable from the pair of pivot members by an operator to mount or demount the pivot to convert the handwash station from the left version to the right version and vice versa. Preferably, the pivot shaft is manually releasable without a need of a tool. A pivot shaft may be completely removable from the handwash station. Preferably, the pivot shaft is slidable connected to one of the sink unit and the base body, such that the pivot shaft can be shifted out of a pivot without being completely removed from either the base body or the sink unit. Beneficially, the non-removable pivot shaft cannot be loosened from the handwash station.

In an embodiment of the handwash station according to the invention, the pivot shaft is insertable into one of the left and right pivot from a back side of the base body. Through holes may be provided at the back side of the base body for receiving a pivot shaft to establish a connection between a pair of pivot members. The insertion of a pivot shaft from the backside of the base body is beneficial to keep the pivot shaft out of reach for a user. Herewith, the conversion of the handwash station is protected against vandalism.

In an embodiment of the handwash station according to the invention, the sink unit is out of centre positioned over a certain distance relative to the base body. In particular, the faucet for dispensing water is offset positioned from a centre line of the base body. Preferably, the sink unit has a sink portion which in a closed position of the handwash station protrudes from side wall of the base body. The sink portion is a lateral portion which may be part of the sink or provide a surface besides the sink. The protruding sink portion may serve as a stopper of the sink unit when moving the sink unit from the closed position to an open position. Preferably, the sink unit is rotated at least 90°, in particular about 95°, to get the sink unit in a stable position in which the sink portion abuts against a side wall of the base body. The stopper formed by the sink portion is beneficial in that a full access to the inner space of the base body is provided to an operator to carry out maintenance. The handwash station may remain free of obstructive additional items, like a chord or a link, to keep the sink unit in the open position.

In an embodiment of the handwash station according to the invention, each pivot is formed by a pair of pivot members including a V-shaped pivot member and a V-shaped complimentary pivot member. One of the pair of pivot members is formed by a V-shaped recess for receiving a V-shaped body. The V-shape of a pivot member is beneficial in aligning the sink unit with respect to the supporting base body. The V shape contributes in positioning the sink unit when moving down onto the base body.

In an embodiment of the handwash station according to the invention, the sink unit has a stack recess at a lateral side. The stack recess is configured to partly receive a faucet portion of another sink unit in a stack assembly. The faucet portion protrudes as an upper column above a sink unit. In the stack assembly, a sink unit can be sandwiched in between two neighbouring sink units, wherein the faucet portion of the sink unit is positioned in between stack recesses of the neighbouring sink unit. The faucet portion is enclosed by the neighbouring seal units which provides a protection of the faucet during transport.

Further, the invention relates to a portable restroom including a handwash station according to the invention. Portable restrooms in all kind of appearances are well known in the public area. The portable restroom provides a sanitary space including for example a toilet, urinal or lavatory. According to the invention, a portable restroom provided with a handwash station according to the invention is provided, wherein the handwash station has a back side which is positioned against a side wall of the sanitary space. A user position in front of the handwash station provides access to the sink unit of the handwash station. In particular, the handwash station is positioned at a corner of the sanitary space. The available convertibility of the handwash station allows an optimal placement in the corner of the sanitary space, wherein the sink unit is pivotable away from the base body in a direction away from the corner.

The invention will be explained in more detail with reference to the appended drawings. The drawings show a practical embodiment according to the invention, which may not be interpreted as limiting the scope of the invention. Specific features may also be considered apart from the shown embodiment and may be taken into account in a broader context as a delimiting feature, not only for the shown embodiment but as a common feature for all embodiments falling within the scope of the appended claims.

DETAILED DESCRIPTION OF THE INVENTION

Figure 1:
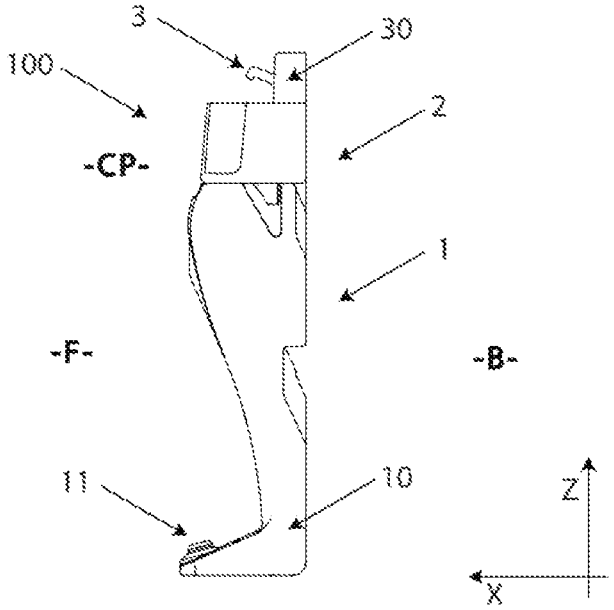
FIG. 1 shows a side view of an embodiment of a handwash station according to the invention.

In FIGS. 1-9 and 13-15, a handwash station in an embodiment according to the invention is denoted overall by reference numeral 100. Identical reference signs are used in the drawings to indicate identical or functionally similar components. To facilitate comprehension of the description and of the claims the words vertical, horizontal, longitudinal, cross-sectional and a coordinate system X, Y, Z shown in the drawings—with reference to gravity and normal placement of the hand wash station in use—are to be interpreted in a non-limiting way.

FIG. 1-9 show the coordinate system including a X-, Y-, Z-axis. The Z-axis defines a vertical direction or a height of the handwash station. The X- and Y-axis define a XY plane which is a horizontal plane, in which the X-direction defines a depth and the Y-direction defines a lateral direction, a width of the handwash station. The Y- and Z-axis define a YZ-plane which is a vertical plane in width direction.

The handwash station as shown in FIG. 1-9 is suitable to be placed inside a portable restroom, in particular an outdoor portable restroom, which are typically very narrow. The portable restroom provides a sanitary space with a floor and a side wall. The handwash station is placed against the side wall. Typically, the handwash station is structured by components made of a plastic material, in particular by moulding, more in particular by centrifugal plastic casting.

As shown in FIG. 1, the handwash station 100 is accessible from a front side F. A user stands at a user position in front of the handwash station when washing his hands. The handwash station 100 has a planar back side B which is arranged to be placed against a wall. The handwash station 100 including the planar back is arranged to be placed inside a portable restroom against a side wall.

The handwash station has a user operable tool for operating a faucet 3 for dispensing water. Here, the handwash station has a foot pedal 11 at the front side F. The user may operate the foot pedal 11 or alternatively a manually operable stick or button for supplying water to the faucet 3 for dispensing water. The faucet 3 is positioned at a faucet portion 30 which protrudes above a sink 20 of the sink unit 2. Here, the faucet portion 30 is centrally positioned adjacent the sink 20 at a back side of the sink unit.

The handwash station 100 has a base body 1 and a sink unit 2. The base body 1 is arranged to support the sink unit 2. The base body 1 and the sink unit 2 are separate items. The sink unit 2 is coupled to the base body 1. The sink unit 2 is movable away from the base body 1. Each of the base body 1 and the sink unit 2 have a planar back side which are in assembly aligned with each other. Herewith, the handwash station formed by the stacked base body 1 and sink unit 2 is suitable to be placed against a wall of a portable restroom.

In FIG. 1, the handwash station 100 is shown in the closed position CP. The closed position CP is an operational configuration of the handwash station 100. In the closed position CP, the sink unit 2 is positioned on top of the base body 1. The sink unit 2 closes an inner space of the base body 1. The inner space of the base body 1 normally serves as a water storage. The inner space may form a water storage for clean and/or used water.

Figure 2:
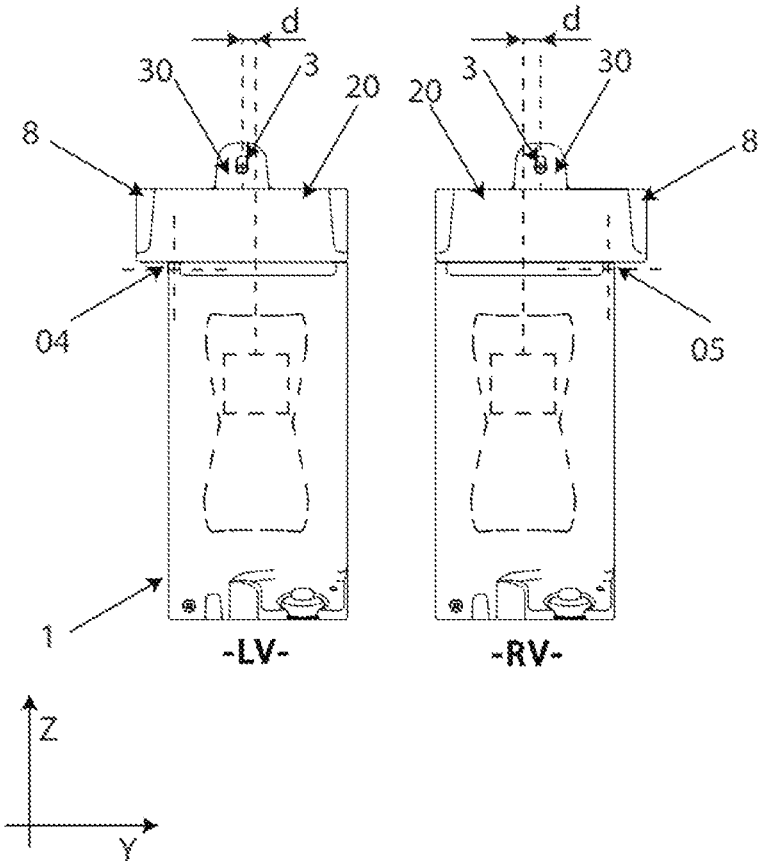
FIG. 2 shows a left and a right version of the handwash station as shown in FIG. 1.

FIG. 2 shows a left and right version LV, RV of the handwash station 100. The handwash station 100 according to the invention includes an improvement in that the handwash station 100 is convertible from a left to a right version LV, RV and vice versa. In the left version of the handwash station 100, the sink unit 2 is pivotable about a left pivot 4 having a pivot axis 04 being positioned at a left region of the handwash station. In the right version RV of the handwash station 100, the sink unit 2 is pivotable about a right pivot 5 having a pivot axis 05 which is positioned at a right region of the handwash station.

Here, in the left version LV, the sink unit 2 is positioned out of centre relative to the base body 1 over a distance 'd' to the left. In the left version LV, a sink portion 8 of the sink unit 2 protrudes at a left region from a side wall of the base body 1. The right version RV of the handwash station 100 is obtained by an out of centre positioning of the sink unit 2 relative to the base body 1 over a distance 'd' to the right. In the right version RV, a sink portion 8 protrudes at a right region from the base body 1. The sink portion 8 is a portion of the sink unit 2 which may include a portion of the sink 20.

Figure 3:
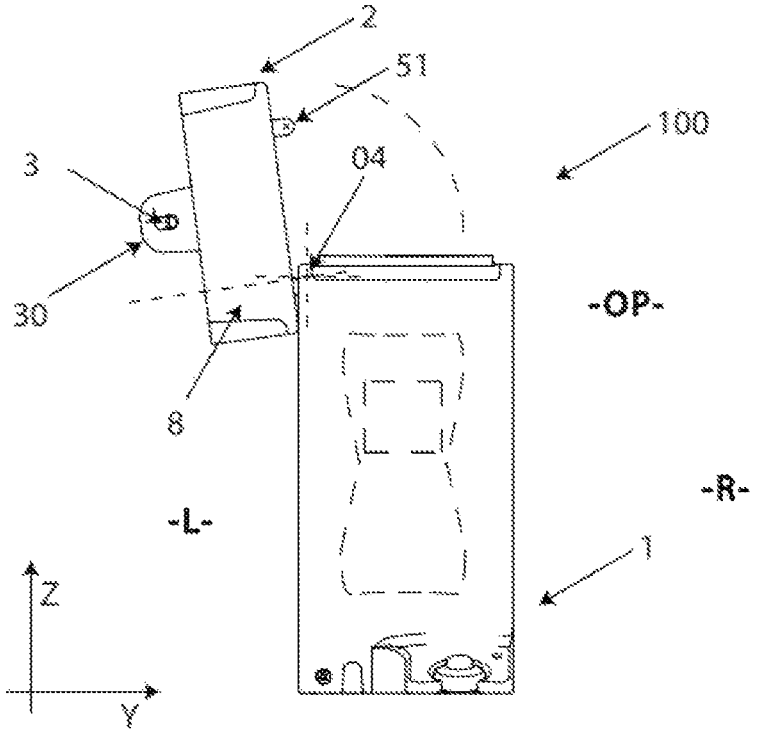
FIG. 3 shows the left version of the handwash station in an open position.
Figure 4:
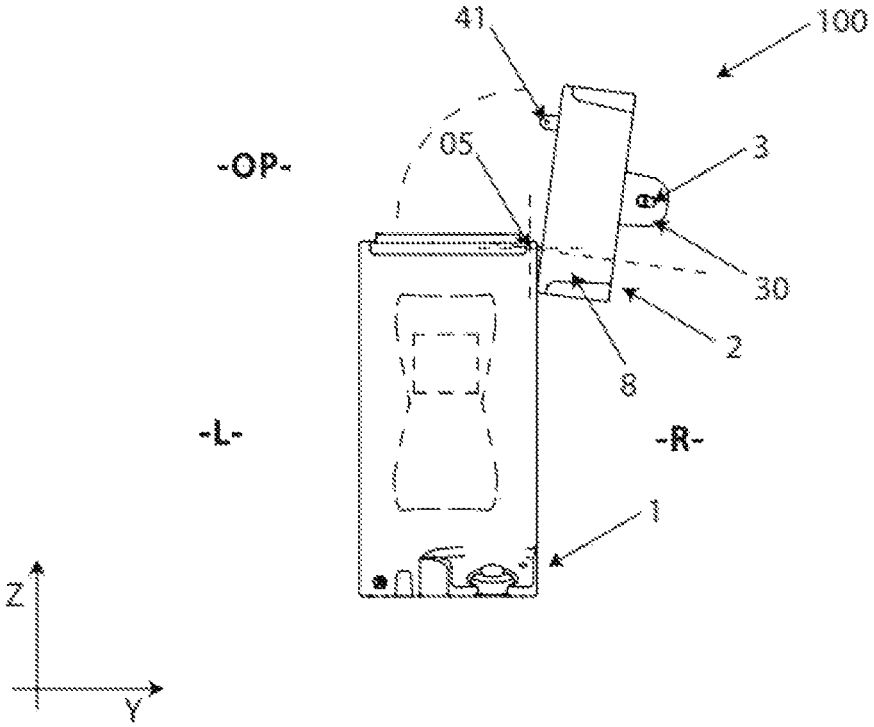
FIG. 4 shows the right version of the handwash station in an open position.
Figure 5:
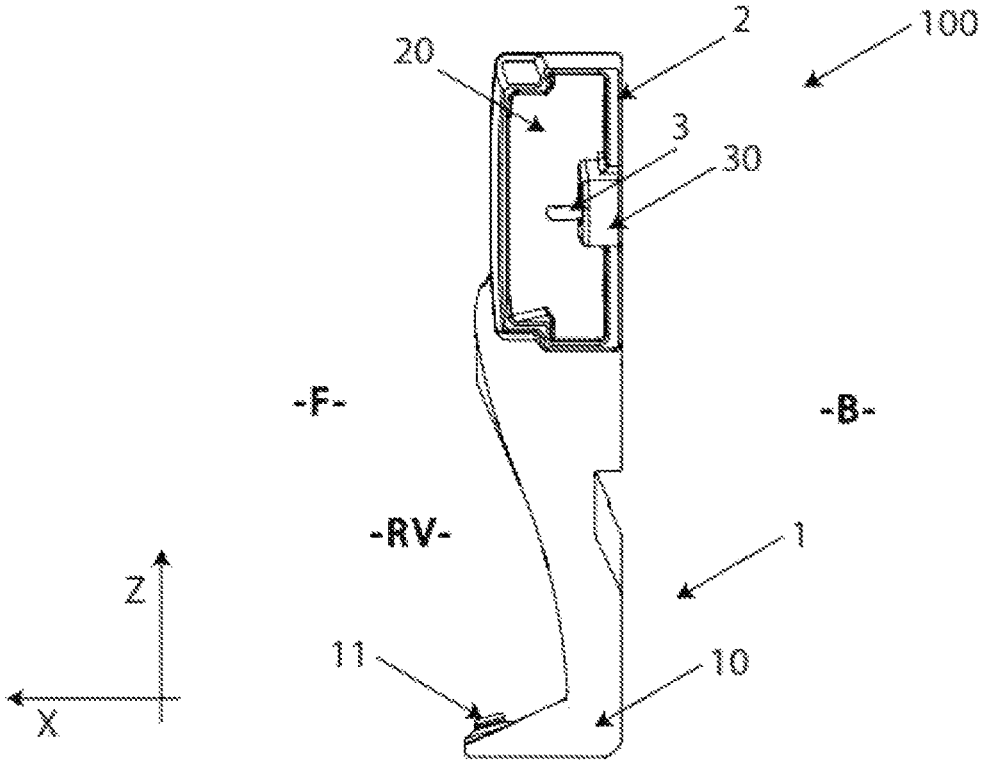
FIGS. 5-8 shows the left version of the opened handwash station in several views.
Figure 6:
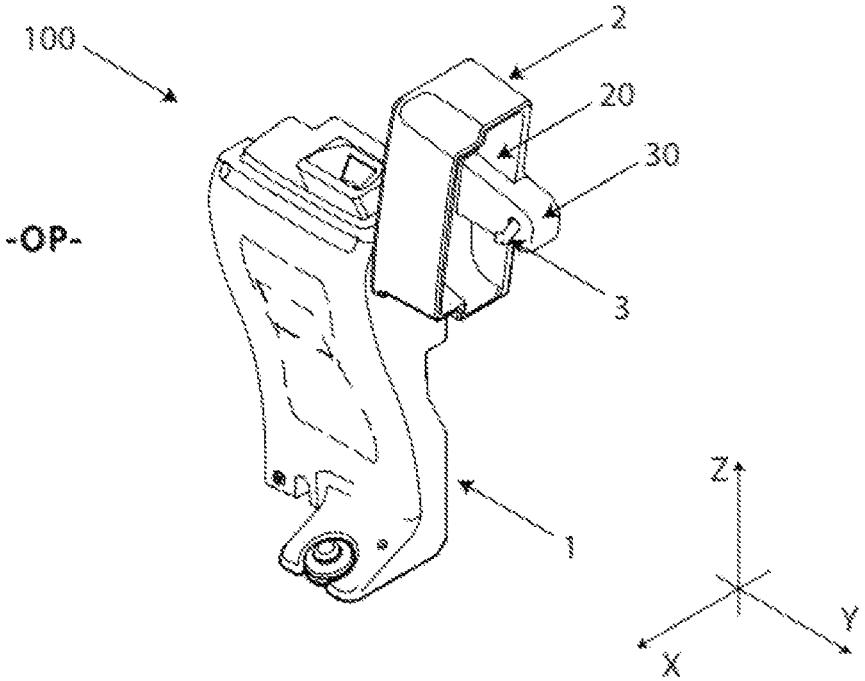

FIG. 3 shows the left version LV of the handwash station 100 in an open position OP. In the open position, a maintenance to the handwash station can be carried out. In the open position OP, an access is provided to the inner space of the base body 1. An operator may empty or replenish a water storage inside the base body 1. In the open position OP, the sink unit 2 is pivoted to the left L about the left pivot 4 having a left pivot axis 04 situated in a left region of the base body 1. The sink unit 2 is pivoted about an angle of at least 90°, in particular about 95°, and has obtained a stable position in which the sink portion 8 abuts against a left side wall of the base body 1. In FIG. 3, a right pivot member 51 is visible which is decoupled from a complementary right pivot member 52 at the base body 1.

FIG. 4-8 show several views of the right version RV of the handwash station 100 in an open position OP. In the open position OP, the sink unit 2 is pivoted about a right pivot axis 05 to the right side R. The sink unit 2 is pivoted about an angle of at least 90° and has obtained a stable position in which the sink portion 8 abuts against a right side wall of the base body 1.

Figure 7:
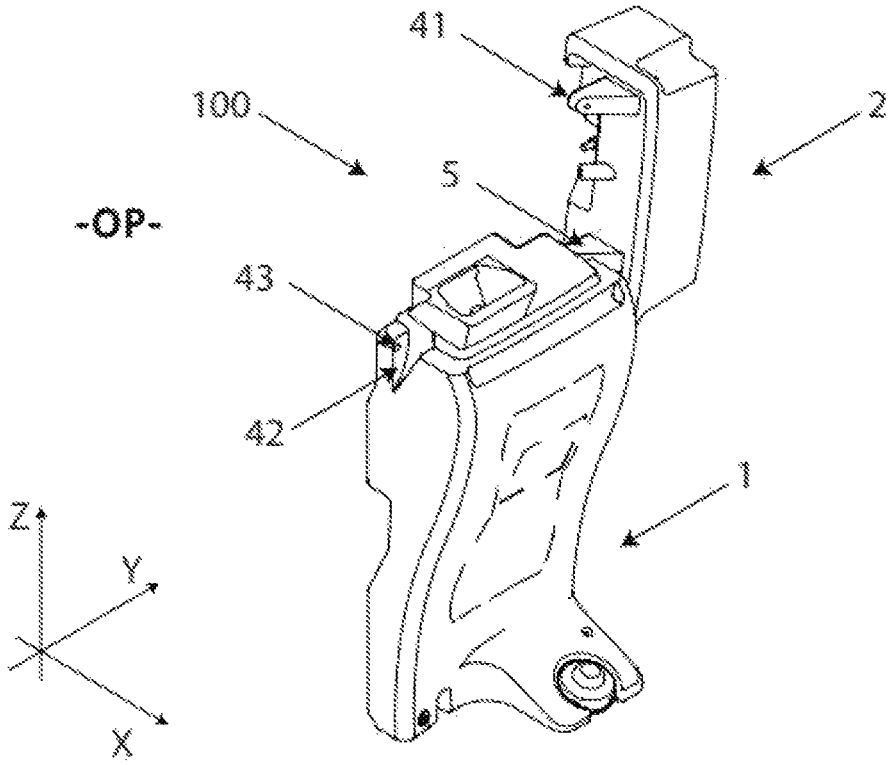
Figure 8:
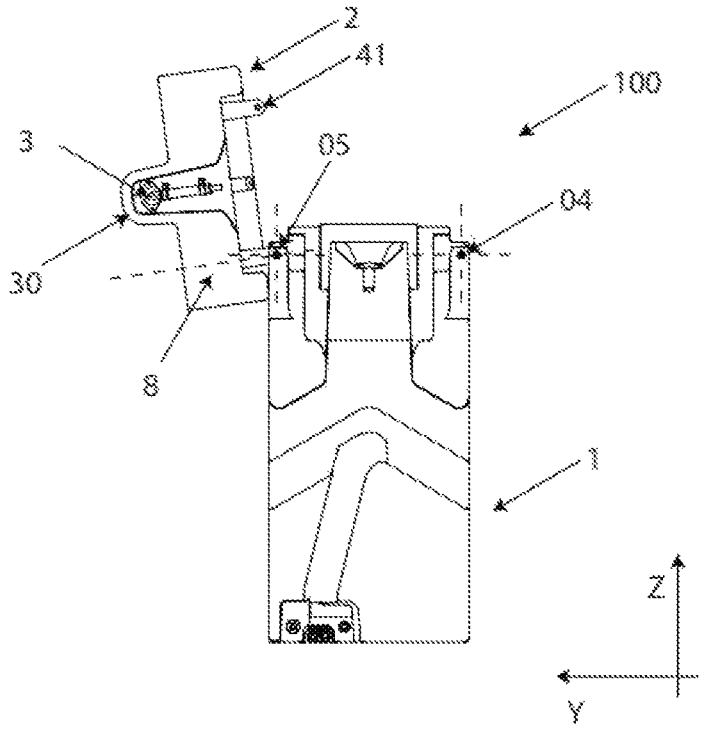

In FIG. 7, the left pivot member 41 is visible which is decoupled from a complementary left pivot member 42 at the base body 1. Here, both pivot members 41, 42 have a V-shape. The left pivot member 41 has a downwardly tapered shape. To couple the left pivot member 41 to the complementary left pivot member 42, the left pivot member 41 is to be received in the complementary left pivot member 42 which is formed by a V-shaped recess which has an upwardly tapered shape.

A through hole 43, 53 extending in the frontal direction is provided in the first and second pivot member 41, 51 for receiving a pivot shaft (not shown). The complementary pivot members 42, 52 have complementary holes for receiving the shaft. By mounting the shaft, a selective pivot member 41, 51 can be coupled to the complementary left pivot member 42, 52.

Figure 9:
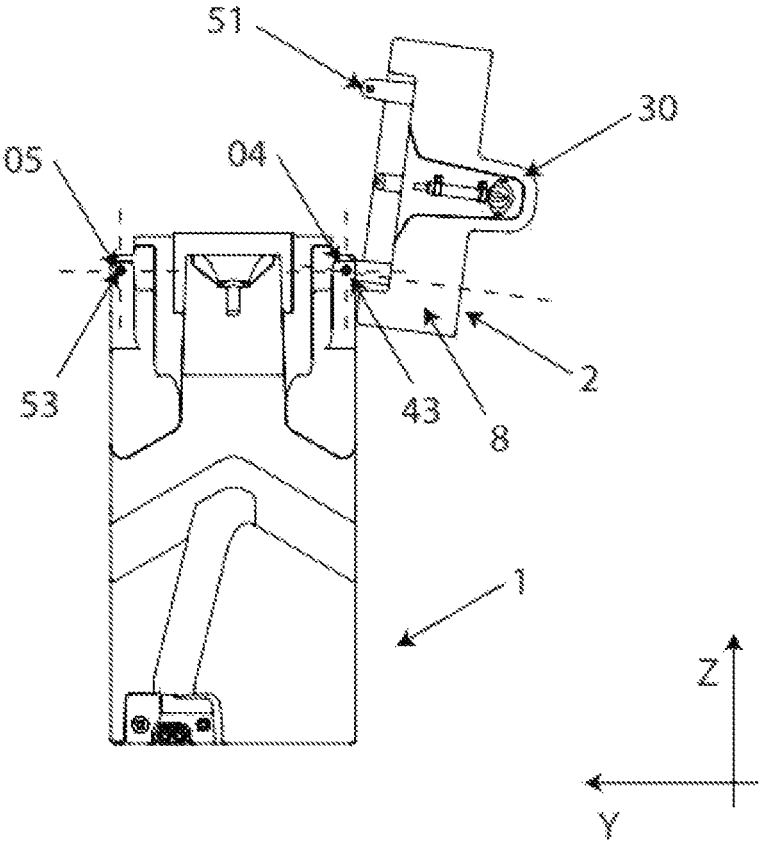
FIG. 9 shows a rear view of the right version of the handwash station.

FIG. 9 shows a rear view of the left version LV the handwash station 100 in the open position OP in which the sink unit 2 is rotated about the left pivot axis 04. The complementary through holes 43, 53 defining the left and right pivot axes 04, 05 are visible from the rear of the handwash station. An operator may mount or demount the pivot shaft from the backside B of the handwash station to convert the handwash station to the left or right version LV, RV. Here, in the shown right version RV, the left pivot 4 defining the left pivot axis 04 is functionally coupled. The right pivot member 51 is decoupled from its complementary right pivot member 52 which renders the right pivot axis 05 out of function.

Figure 10:
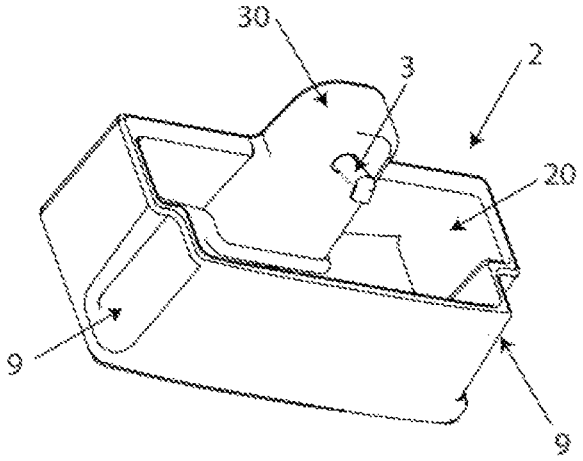
FIG. 10 shows a perspective view of a stackable sink unit of the handwash station.

FIG. 10 shows the sink unit 2 in a perspective view. The sink unit 2 can be manufactured by blow moulding. The sink unit 2 has a sink 20 which is formed by a recess having a peripheral wall forming an outer contour of the sink unit. At a middle region, the sink unit has a faucet portion 30 protruding from the sink 20. A faucet 3 is mounted to the faucet portion 30 and extends from the faucet portion 32 to a centre region of the sink 20. At each lateral side L, V, the sink unit 2 is provided with a stack recess 9. The stack recess 9 contributes to obtain a stable stack assembly for transport.

Figure 11:
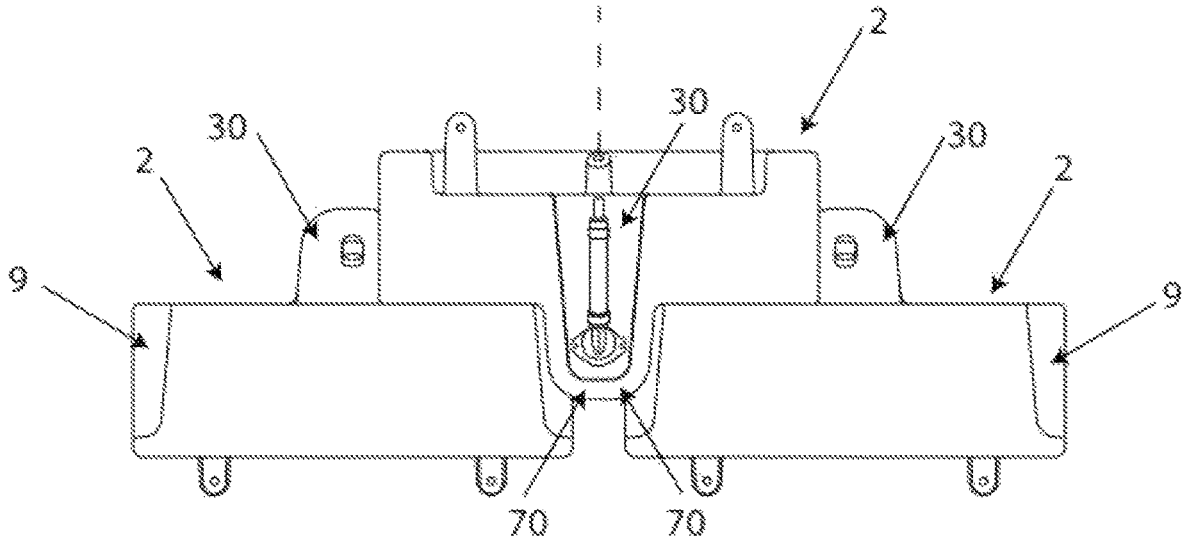
FIGS. 11 and 12 show a stacked assembly of several sink units in which a faucet portion is nested in between neighbouring sink units.
Figure 12:
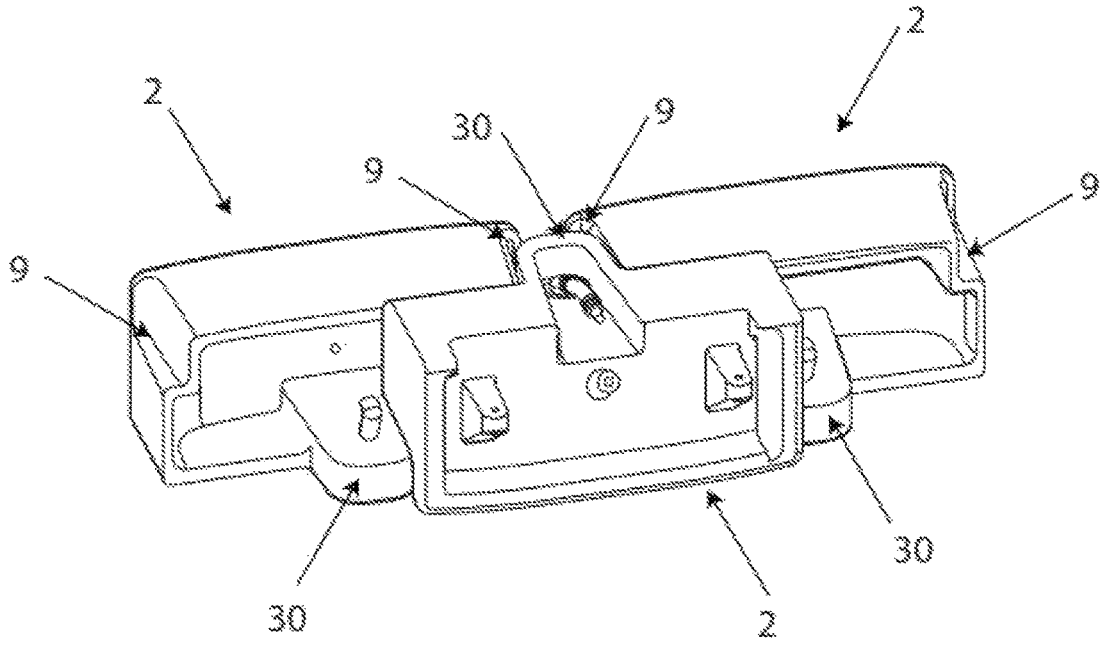

As shown in FIGS. 11 and 12, in stacking several sink units, the stack recess 9 of a particular sink unit is configured for partially receiving a faucet portion 30 of another sink unit in the stack assembly. In the stack assembly of sink units, the faucet portion 30 is positioned in between two stack recesses of neighbouring sink units. Advantageously, the faucet 3 is positioned in a protective manner to prevent damages to the faucet 3.

Figure 13:
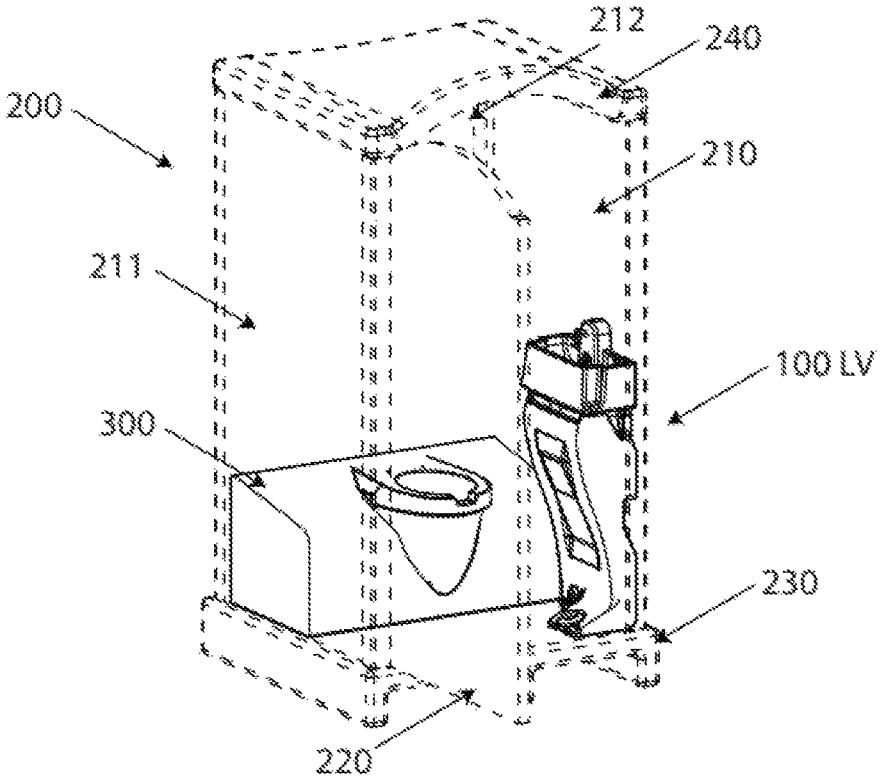
FIGS. 13 and 14 show a perspective view of a portable restroom including a handwash station as shown in FIGS. 1-9 behind a door.
Figure 14:
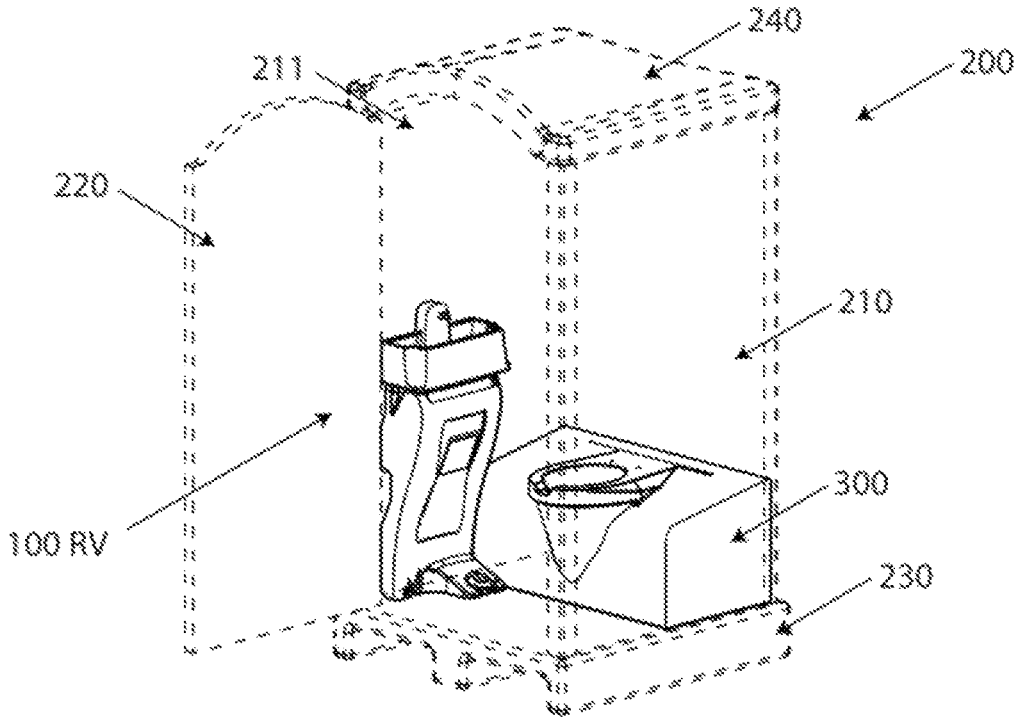

FIGS. 13 and 14 show a portable restroom 200 for providing a sanitary unit at an outdoor location. The portable restroom has a cabin including a left and right side wall 210, 211, a rear wall 212, a door 220, a bottom 230, and a roof 240. The cabin forms a sanitary space. The sanitary space is accessible for a user. Typically, the portable restroom is arranged to provide an outdoor sanitary unit in a public area. The bottom 230 has a pallet shape including two lower apertures for receiving forks of a forklift. The pallet-shaped bottom 230 allows an easy transport of the portable restroom. The bottom 230 provides a floor 231 inside the cabin. Typically, the floor has a floor area of about 1.0 $m^2$. Inside the cabin, a toilet 300 is situated against the rear wall 212.

The left and right side wall 210, 211 are available for a placement of the convertible handwash station as shown in FIGS. 1-9. In FIG. 13, the handwash station 100 is positioned—seen from the rear wall—against the left sidewall 210 in the left version LV of the handwash station. In the left version LV, the sink unit 2 is pivotable away from the door 220. In FIG. 14, the handwash station 100 is positioned—seen from the rear wall—against the right side wall 211 in the right version RV of the handwash station. In the right version RV, the sink unit 2 is also pivotable away from the door 220. Hence, the convertibility of the handwash station allows a placement of the same handwash station against a selective left or right side wall 210, 211. The selective left or right version always enables a pivotable release of the sink unit for maintenance.

Figure 15:
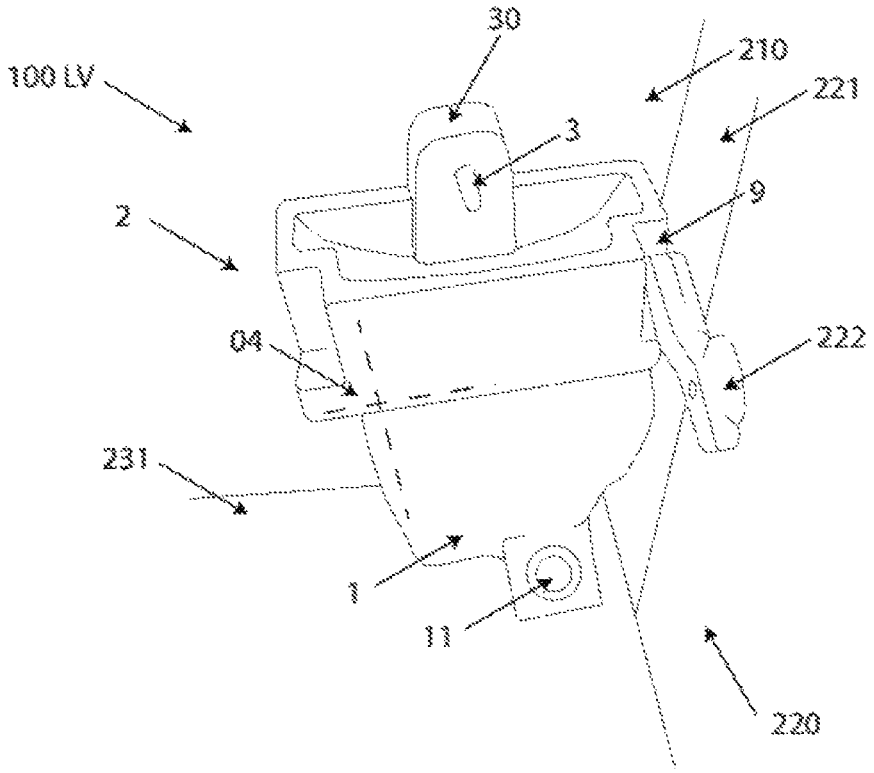
FIG. 15 shows a perspective view of a door latch inside a restroom for locking the door to a door frame, wherein the door latch is receivable inside a laterally and frontally positioned recess of the sink unit.

FIG. 15 shows the left version LV of the handwash station 100 as shown in FIG. 13 in an enlarged view. The handwash station 100 has a pivot axis 04 enabling the sink unit 2 to pivot to the left. The sink unit still has a stack recess 9 at a side portion at a front region of the sink unit 2. The stacked recess 9 at the front region is beneficial to provide a space allowing a door latch 222 to tumble behind a door frame 221.

Numerous variants are possible in addition to the embodiment shown in the figures. For example, in a variant of the illustrated embodiment of the handwash station, an alternative embodiment of the handwash station may comprise a centrally positioned sink unit on top of the base body without having a protruding sink portion at a lateral side of the base body.

Although the present invention has been described in detail, it will be apparent to those skilled in the art that various changes and modifications can be made without departing from the scope of the invention as hereinafter claimed. It is intended that all such changes and modifications be encompassed within the scope of the present disclosure and claims.

Further, it is remarked that any feature of the system according to the invention which is described in the embodiments and/or mentioned in the dependent claims is in itself considered patentable without any dependency to another presented feature. In particular, any measure presented in a dependent claim is also considered patentable without dependency of the independent claim.

Thus, the invention provides a handwash station and a portable restroom provided with such a handwash station, wherein the handwash station is frontally accessible from a user position, in which the hand-wash station has a base body including a front side, left side, and right side, which base body supports a pivotally connected sink unit including a sink and a faucet for dispensing water. An improvement is provided in that the handwash station is convertible from a left to a right version. In the left version, the sink unit is pivotable to the left side about a left pivot, and in the right version, the sink unit is pivotable to the right side about a right pivot. Due to the convertibility, the same handwash station is suitable to be placed either against a left or a right side wall of a portable restroom.

| Reference signs list: | |
|---|---|
| OP open position | 230 bottom |
| CP closed position | 231 floor |
| LV left version | 240 roof |
| RV right version | 300 toilet |
| F front side | |

-continued

| Reference signs list: | |
|---|---|
| B back | |
| L left side | 1 base body |
| R right side | 10 base foot |
| | 11 foot pedal |
| 100 hand wash station | |
| 200 portable restroom | 2 sink unit |
| 210 left side wall | 20 sink |
| 211 right side wall | |
| 212 rear wall | 3 faucet |
| 220 door | 30 faucet portion |
| 221 doorframe | |
| 222 latch | 4 left pivot |
| 04 left pivot axis | 51 right pivot member |
| 41 left pivot member | 52 complementary right pivot member |
| 42 complementary left pivot member | 53 pivot shaft |
| 43 pivot shaft | |
| | 8 sink portion |
| 5 right pivot | 9 stack recess |
| 05 right pivot axis | |

What is claimed is:

1. A handwash station being frontally accessible from a user position, in which the hand-wash station has a base body including a front side, a left side and a right side, which base body supports a pivotally connected sink unit including a sink and a faucet for dispensing water, wherein the handwash station is convertible from a left to a right version, wherein in the left version, the sink unit is pivotable to the left side about a left pivot, and wherein in the right version, the sink unit is pivotable to the right side about a right pivot.

2. The handwash station according to claim 1, wherein each pivot comprises a pivot shaft which is releasable by an operator to selectively mount or demount the pivot to convert the handwash station from the left version to the right version and vice versa.

3. The handwash station according to claim 1, wherein the pivot shaft is a non-removable item, wherein the pivot shaft is slidable connected to one of the sink unit and the base body to be shifted in or out the pivot for respectively mounting or demounting the pivot.

4. The handwash station according to claim 1, wherein the pivot shaft is insertable into one of the left and right pivot from a back side of the base body.

5. The handwash station according to claim 1, wherein in the left version, the sink unit is out of centre positioned over a distance relative to the base body.

6. The handwash station according to claim 5, wherein the sink unit has a lateral portion which in a closed position of the handwash station protrudes from a sidewall of the base body.

7. The handwash station according to claim 6, wherein in an open position of the handwash station, the sink unit is pivoted about an angle of at least 90°, wherein the sink portion abuts against the sidewall of the base body.

8. The handwash station according to claim 1, wherein each pivot is formed by a pair of complementary pivot members, wherein each of the pivot members have a V-shape.

9. The handwash station according to claim 1, wherein the sink unit has a stack recess at a lateral side which is configured to partly receive a faucet portion of another sink unit in a stack assembly.

10. The handwash station according to claim 1, wherein in the right version, the sink unit is out of centre positioned over a distance relative to the base body.

11. A portable restroom for providing a sanitary unit at an outdoor location, wherein the portable restroom has a sanitary space being accessible for a user which sanitary space is formed by a floor and a plurality of sidewalls, wherein the handwash station of claim 1 is positioned against one of the plurality of sidewalls of the sanitary space.

12. The portable restroom according to claim 11, wherein the restroom comprises a door having a door latch to lock the door behind a door frame, wherein the sink unit has a stack recess at a front region which provides a space for receiving the door latch.

* * * * *